US008881423B2

(12) United States Patent
Ragosta et al.

(10) Patent No.: US 8,881,423 B2
(45) Date of Patent: Nov. 11, 2014

(54) CONCENTRATOR

(71) Applicants: Michael A. Ragosta, Calabasas, CA (US); Bruno Meglio, Beverly Hills, CA (US); Claudio Marino, Woodland Hills, CA (US); David Richmond, Culver City, CA (US); Howard Richmond, Los Angeles, CA (US)

(72) Inventors: Michael A. Ragosta, Calabasas, CA (US); Bruno Meglio, Beverly Hills, CA (US); Claudio Marino, Woodland Hills, CA (US); David Richmond, Culver City, CA (US); Howard Richmond, Los Angeles, CA (US)

(73) Assignee: M. M. & R. Products, Inc., Calabasas, CA (US)

( * ) Notice: Subject to any disclaimer, the term of this patent is extended or adjusted under 35 U.S.C. 154(b) by 0 days.

(21) Appl. No.: 13/673,706

(22) Filed: Nov. 9, 2012

(65) Prior Publication Data

US 2014/0053426 A1 Feb. 27, 2014

Related U.S. Application Data

(60) Provisional application No. 61/693,136, filed on Aug. 24, 2012.

(51) Int. Cl.
*A45D 20/12* (2006.01)
*A45D 20/00* (2006.01)

(52) U.S. Cl.
CPC ..... *A45D 20/00* (2013.01); *A45D 20/12* (2013.01)
USPC ..... 34/283; 34/98

(58) Field of Classification Search
USPC ..... 34/283, 96, 97, 98, 99, 100, 101; 132/212, 112; D28/12, 13, 18, 19
See application file for complete search history.

(56) References Cited

U.S. PATENT DOCUMENTS

| | | | | |
|---|---|---|---|---|
| 3,563,250 | A | 2/1971 | DeFalandre | |
| 3,939,850 | A | 2/1976 | Wahl | |
| 4,205,221 | A * | 5/1980 | Meyer | 392/385 |
| 4,538,362 | A | 9/1985 | Andis | |
| 4,629,863 | A * | 12/1986 | Giordano | 34/97 |
| 5,316,025 | A | 5/1994 | Sahm | |
| 5,894,849 | A * | 4/1999 | Ehlhardt et al. | 34/97 |
| 5,956,863 | A | 9/1999 | Allen | |
| D426,674 | S | 6/2000 | Kwong | |

(Continued)

FOREIGN PATENT DOCUMENTS

| | | | | |
|---|---|---|---|---|
| CN | 202341168 | * | 6/2011 | A45D 20/12 |
| EP | 1 587 392 B1 | | 9/2007 | |

(Continued)

OTHER PUBLICATIONS

International Search Report mailed on Jan. 31, 2014, for application No. PCT/US2013/056427, filed Aug. 23, 2013, 8 pages.

*Primary Examiner* — Kenneth Rinehart
*Assistant Examiner* — Tavia Sullens
(74) *Attorney, Agent, or Firm* — Laura M. Lloyd; Jeffrey G. Sheldon, Esq.; Leech Tishman Fuscaldo & Lampl

(57) ABSTRACT

A hair treatment device has a body and a blower supported by the body from which air is blown. A concentrator separately connected to the body or integral with the body comprises at least one gas flow conduit in gas flow communication with the blower. A nozzle is in gas flow communication with a distal portion of the conduit and is oriented to blow air from a distal portion of the first conduit back toward the body.

12 Claims, 5 Drawing Sheets

(56) References Cited

U.S. PATENT DOCUMENTS

| | | | |
|---|---|---|---|
| 6,199,295 | B1 | 3/2001 | Smal et al. |
| D440,354 | S | 4/2001 | Kwong |
| 7,152,610 | B2 | 12/2006 | Csavas |
| 7,481,228 | B2 | 1/2009 | Ragosta et al. |
| 7,631,646 | B2 | 12/2009 | Ragosta et al. |
| 2002/0189128 | A1 | 12/2002 | Nakagawa et al. |
| 2005/0257395 | A1 | 11/2005 | Keong |
| 2011/0277335 | A1* | 11/2011 | Prehodka ..... 34/96 |
| 2012/0291301 | A1* | 11/2012 | Silva ..... 34/98 |
| 2012/0311882 | A1* | 12/2012 | Yoe ..... 34/98 |

FOREIGN PATENT DOCUMENTS

| | | | | |
|---|---|---|---|---|
| FR | WO2007003795 | A2 | 1/2007 | |
| FR | 2888095 | A1 | 12/2007 | |
| WO | WO2011094830 | * | 8/2011 | ..... A45D 20/46 |

* cited by examiner

CONCENTRATOR

CROSS-REFERENCE TO RELATED APPLICATION

This application claims the benefit of U.S. Provisional Patent Application No. 61/693,136 titled "Concentrator," filed on Aug. 24, 2012, the contents of which are incorporated herein by reference in their entirety.

BACKGROUND

Hair drying devices deliver a stream of hot air for drying and shaping hair into a desired style. A diffuser is commonly used to disperse the air flow from a hair drying device thereby creating curls, body and texture without frizz. Under certain circumstances it is desirable to modify the design of a hair drying or styling device or its attachments in order to achieve a certain hair style.

Consumers often pay a premium to have their hair professionally blown dry to achieve a finished salon look. Hairdressers operate meticulously by drying and styling specific parts of the hair at one time. When drying hair, the hairdresser uses a brush, selects a small section of hair, and repeatedly applies heat to the hair. By concentrating the heat on a particular section and simultaneously pulling the brush in a desired direction, the drying process shapes the hair creating volume and style. For example, when the heated air from the dryer is applied, and the brush is pulled downward toward the ends of the hair a smooth finish is created.

Modifications to hair drying devices to improve performance can be found in U.S. Pat. Nos. 3,563,250, 5,956,863, 3,939,850, 6,199,295, and 5,316,025. However each of these modifications suffers from one or more disadvantages such as complexity, high cost, and limited effectiveness. For example, most hair dryer modifications have awkward configurations, making the drying process even more challenging for the user which can be tiresome and frustrating.

Typically hair dryers have a tubular body that houses a blower defining an air intake and air outlet. An electric motor is provided to run an internal fan which draws air from the environment into the air intake. The air is generally forced across a heating element toward the air outlet. The heated air flows through the air outlet and out of the body surrounding the air outlet. The circular cross section dries and flattens the surface of the hair, while the hair underneath remains wet for a longer period of time.

A conventional hair drying device without an accessory attached has a circular cross section flow pattern. Accessories can be attached to the body surrounding the air outlet of the hair dryer. The heated air flows through the body and exits the air outlet and through the accessory altering the flow pattern of the air. A variety of accessories are known for altering the flow pattern of air from the hair dryer, such as those described in U.S. Pat. Nos., D426674, 4,538,362, 71,521,610, D440354, and French Patent No. 2888095. However, each of these suffers from one or more of the disadvantages of low efficiency, and inability to create volume and a smooth finished hair style.

For the foregoing reasons, there is a need for a hair treatment device that overcomes the disadvantages of prior devices.

SUMMARY

A hair treatment device having features of the present invention satisfies the above-identified needs. An exemplary device has a body and a blower supported by the body from which air is blown. A concentrator separately connected to the blower or integral with the blower comprises at least one gas flow conduit in gas flow communication with the blower. A nozzle is in gas flow communication with a distal portion of the conduit and is oriented to blow air from the distal portion of the first conduit back toward the body.

Advantageously, the gas flow conduit has a longitudinal axis and the nozzle directs the air from the distal portion of the gas flow conduit toward the body at an angle greater than one hundred degrees relative to the longitudinal axis to direct air on the exterior surface of the hair.

The body can comprise two such gas flow conduits, each having a nozzle in gas flow communication with the respective conduit, both nozzles oriented to blow air from the distal portion of the respective conduit toward the body. Preferably, the longitudinal axes of the conduits are parallel to each other. The diameter of the nozzle outlets can be smaller than the diameter of the gas flow conduits for concentrating the air to increase its velocity.

The hair treatment device can optionally have a bar, which optionally has projecting bristles, positioned between the two gas flow conduits. The bar with projecting bristles is positioned on the device so the air exiting the nozzles intersects with the bristle portion of the device. The bristle portion can be used to engage the hair of a user. The bar can be permanently attached to the device or insertable so that the user can remove the bar. The removable feature allows for bars of various sizes or bristle properties to be inserted into the hair treatment device. For example, the bristle portion can have more of a brush-like configuration or a comb-like configuration. The bar can be of solid construction so that no air travels through the bar or the interior of the bar can be hollow creating an additional air flow path through the device. When the bar has a hollow configuration it can optionally have apertures so that air exits from both the bristle portion of the device as well as the nozzles.

The body may be cylindrically shaped, with the gas conduit portion positioned at one end of body and a gripping section proportioned to fit in a user's hand at the other end. Alternatively, when there is a cylindrically shaped body, the device can have a gripping section positioned substantially perpendicular to that body, and a switch can be positioned on that gripping section.

In use of the device a user grasps the hair treatment device and activates the blower whereby air is forced through an optional heating assembly, and subsequently through the one or more gas flow conduits and the one or more nozzles. The nozzle directs the air toward the body. The user places the hair at a location wherein the directed air along with the bristle portion engages the hair, thereby drying and styling the hair.

When the concentrator is not integral with a blower, it can be used by (a) placing the inlet of the concentrator over the outlet of a hair appliance, b) placing the hair in a location where the air is blown from the nozzle; and c) before or after step (b), activating the hair appliance to blow heated air through the concentrator.

DRAWINGS

These and other features, aspects, and advantages of the present invention will become better understood with reference to the following description, appended claims, and accompanying drawings where:

DESCRIPTION

The present invention is directed to a hair treatment device capable of drying and styling hair, and a method for doing the same. In the following description, numerous specific details are set forth to provide a more thorough description of embodiments of the invention. It is apparent, however, to one skilled in the art, that the embodiments of the present invention can be practiced without these specific details. In other instances, well known features have not been described in detail so as not to obscure the invention.

Figure 1A:
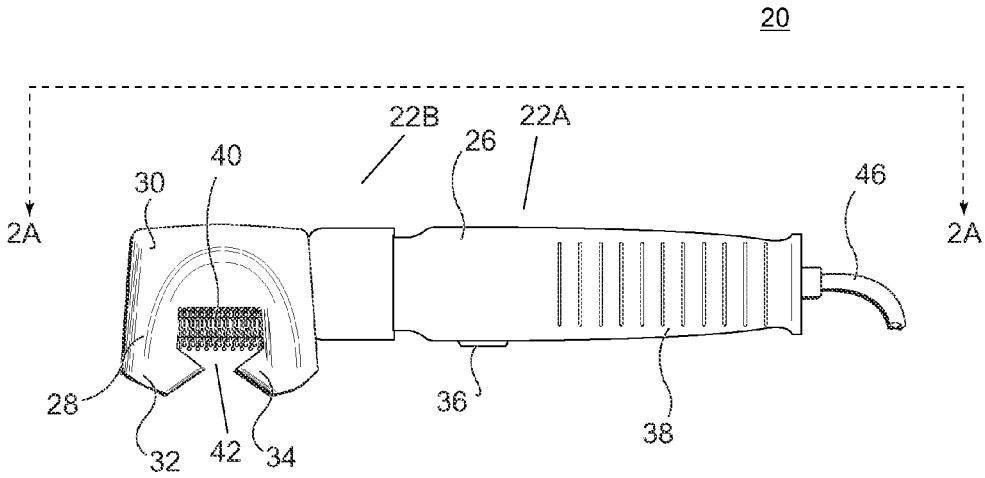
FIG. 1A is a side elevation view of a first hair treatment device having features of the invention.
Figure 2A:
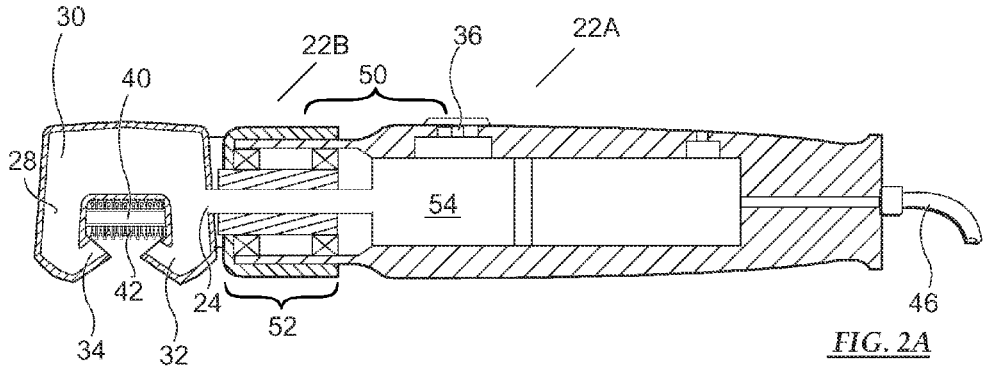
FIG. 2A is a sectional view of the device in FIG. 1A taken on line 2A-2A in FIG. 1A.

Referring to FIGS. 1A and 2A, a hair treatment device 20 comprises a body 22 having a main body section 22A and a concentrator section 22B and an internal cavity 24. A blower 26 supported by the body 22 is within the cavity 24. The concentrator section 22B comprises at least one and preferably two gas flow conduits 28, each having a proximal section 30 in gas flow communication with the blower 26 and a distal section 32 having at least one nozzle 34 in gas flow communication with its respective conduit 28. The nozzles 34 are oriented to direct air from the distal section 32 of the conduit 28 toward the body 22. A switch 36 can be located on the main body section 22A or at another appropriate location to control the hair treatment device 20 heat and/or operating speeds. The exterior of the main body section 22A can be provided with gripping projections 38 for ease in using the device 20. An optional bar 40, optionally with projecting bristles 42, can be located on the device 20 between the conduits 28 to engage the hair of the user.

The gas conduit 28 portion is located at one axial end of the tubular body 22 directing the airflow of forced air into the desired pattern while the gripping projections 38 for the user are located at the other axial end of the body 22.

The device 20 as shown in FIG. 1 illustrates a preferred embodiment with two parallel gas conduits 28 in a horseshoe-type configuration. They each have a longitudinal axis in parallel. The two parallel gas flow conduits 28 work in tandem to direct the air toward a common point. By having more than one gas conduit 28, the air exiting the nozzles 34 is concentrated at the common point. The distance between the two gas conduits 28 can be from about 1 to about 6 inches.

Preferably the nozzles 34 are oriented so that the air is directed by the nozzles 34 toward the body 22 at an angle greater than one hundred degrees relative to the longitudinal axis of the conduits 28. In a preferred embodiment the interior diameters of the nozzles 34 is less than the interior diameters of the gas flow conduits 28. The nozzle 34 openings can optionally be covered with a screen or mesh to prevent hair from being sucked into the openings.

The bar 40 can be located where the air exiting the nozzles 34 intersects with the bristles 42. The bar 40 with projecting bristles 42 can be permanently affixed to the body 22 of the device 20 or can be removable to allow for bars 40 of various sizes and different bristle properties to be used. The cross section of the bar 40 can be square, rectangular, circular or any shape that is suitable for the design of the device. By having bars 40 with various sizes or bristle properties the resulting hair style capability can be changed. The bristles 42 can be a type of hair brush bristle including boar bristles, nylon or other plastic bristles, or a combination of bristle types, such as boar and plastic bristles. The boar and plastic bristles can be of varying stiffness for different brushing applications, such as soft bristles for thin or fine hair, and stiff bristles for thick or coarse hair. The nylon or plastic bristles can have rounded or balled ends to prevent scratching of the scalp, and boar and plastic or nylon bristles may be combined in one brush for yet other hair brushing applications. Other options may also be used for the projections, such as tourmaline, silicon or silicon coated bristles, or other bristle coatings which reduce frizz and enhance smoothing and detangling of the hair. The bar 40 with projecting bristles 42 can be of solid construction or can have an internal hollow cavity. Optionally, when the bar 40 has an internal hollow cavity the bar 40 can have apertures that allow air to exit the bar 40 and flow through the bristles 42.

Figure 1B:
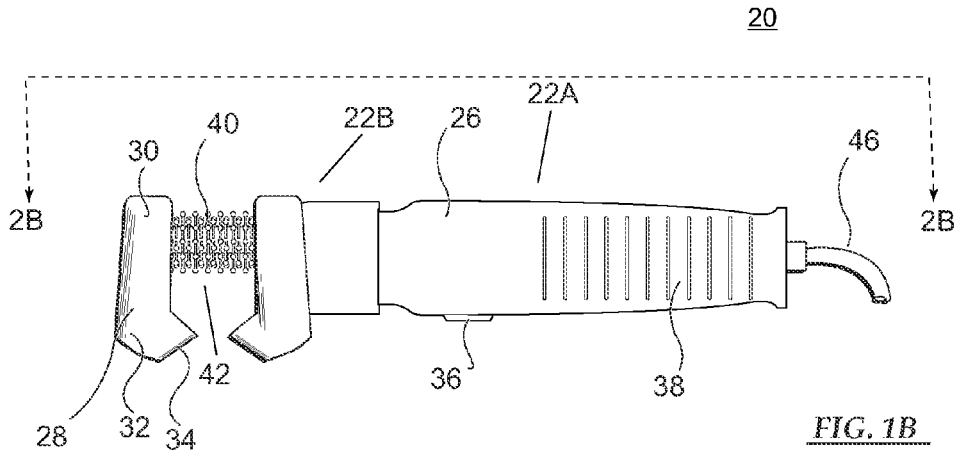
FIG. 1B is a side elevation view of a second hair treatment device having the features of the invention.

FIG. 1B illustrates another version of a hair treatment device that has an alternate body 22 design that can accommodate a larger size bar 40 with projecting bristles 42. In this version the bar 40 with projecting bristles 42 is hollow, creating a flow path so that the forced air from the blower 26 enters the distal gas flow conduit 28 and nozzle 34.

Figure 2B:
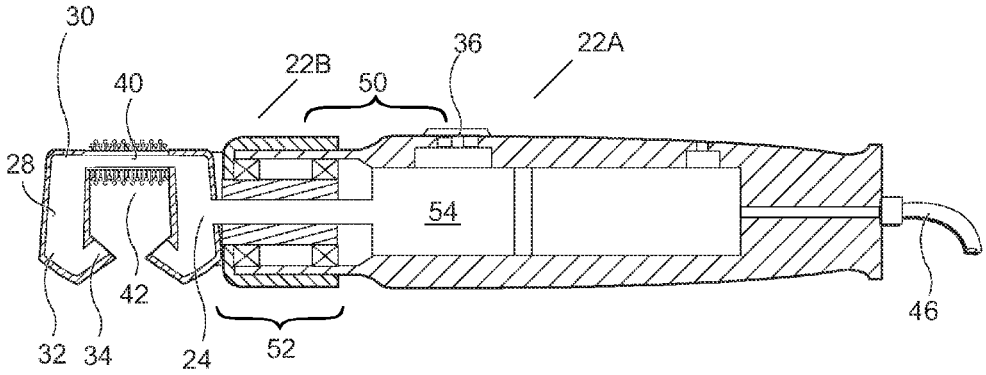
FIG. 2B is a sectional view of the device in FIG. 1B taken on line 2B-2B in FIG. 1B.

As shown in FIGS. 2A and 2B, ambient air is drawn into the internal cavity 24 of the main body section 22A into a gas communication path therethrough so that the air is forced under pressure through the body 22 of the device 20 by the blower 26.

As is typical with hair dryers, the main body section 22A encases the blower 26 and its components. The blower 26 generally comprises a motor to run a fan located internal to the body 22 that is electrically connected with a power source such as AC power by a power cord 46. A heater typically is in the body 22 for heating the air flow travelling therethrough. According to this version, a heated blower 50, which includes a heater assembly 52 and a fan assembly 54, is used. In one exemplary version, the heater assembly 52 performs as a resistor to which current is supplied via power cord 46 or other means. Other examples of a hair styling tool having a heating element may be seen in U.S. Pat. Nos. 7,631,646; and 7,481,228, the entire disclosure of which is hereby incorporated by reference.

Figure 3:
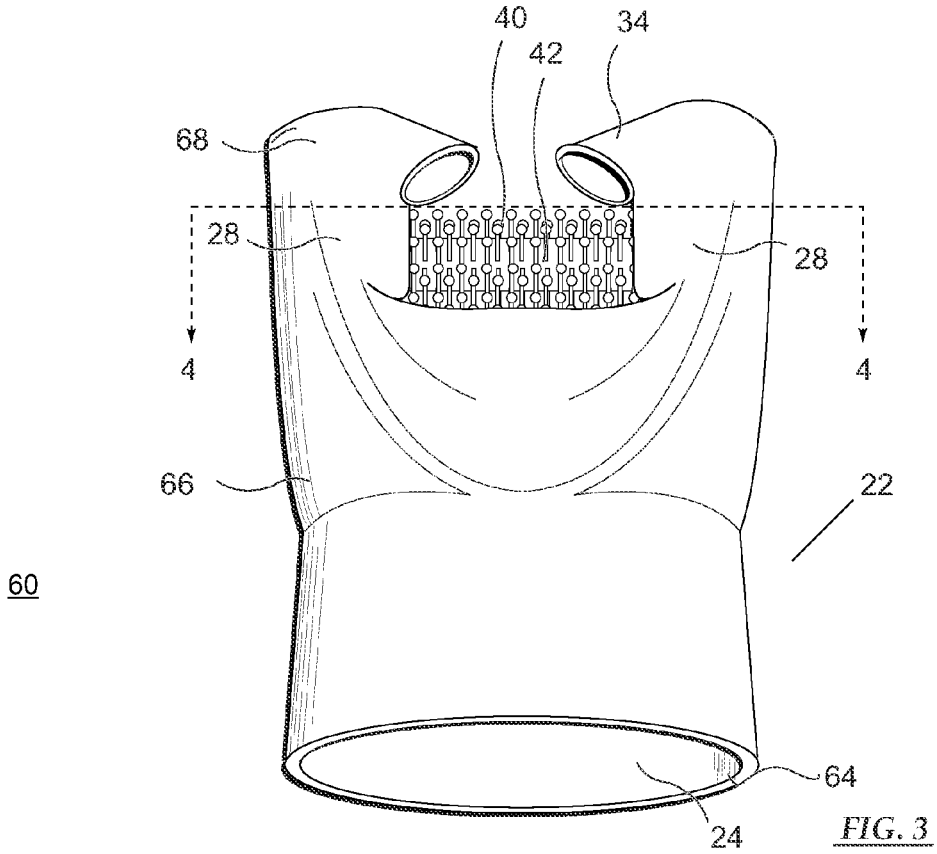
FIG. 3 is a perspective view of a concentrator having the features of the present invention.

Referring now to FIG. 3, rather than having a concentrator 60 integral with a hair blower 26, a concentrator 60 can be a stand-alone unit that can be removably attached to a hair appliance 70 having a blower 26. In a preferred embodiment the hair appliance 70 is a hair dryer. Generally a hair dryer air outlet 62 has a tubular or circular opening, and likewise an inlet 64 portion of the concentrator 60 is tubular and circular in cross section. The concentrator 60 can be placed on the hair appliance 70 before or after the hair appliance 70 is activated.

In this version, the body 22 of the concentrator 60 has a mid-conical section 66 and a discharge end 68, with the mid-conical section 66 being between the inlet 64 portion and the discharge end 68 defining a gas flow path therethrough. In a preferred embodiment the body 22 of the concentrator 60 defines two parallel gas conduits 28 in a horseshoe-type configuration. The body 22 can be made of a variety of materials conventionally used for hair appliances 70, hair dryers and hair dryer attachments, such as metal or plastic, namely polypropylene or combinations thereof.

Figure 4:
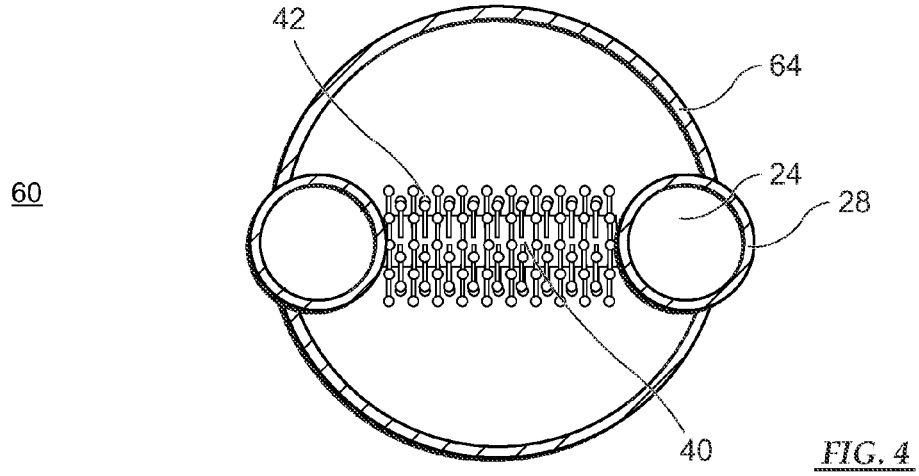
FIG. 4 is a sectional view of the concentrator of FIG. 3 taken on line 4-4 in FIG. 3.

As can be seen in FIG. 4, air flowing through the internal cavity 24 of the body 22 is diverted into the gas conduits 28 which are in gas flow communication with the body 22. The air then passes through the gas conduits 28 and subsequently through the nozzles 34 as shown in FIG. 3 toward a common point. A bar 40 with projecting bristles 42 is located at the common point.

Figure 5:
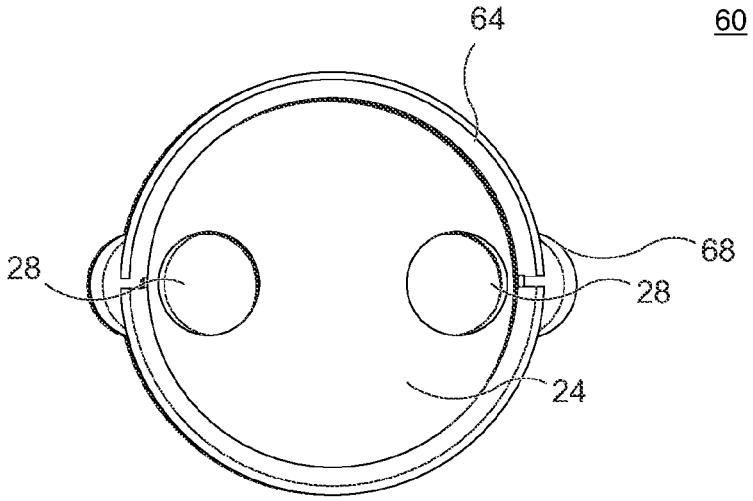
FIG. 5 is a bottom plan view of the concentrator of FIG. 3.

In FIG. 5, a bottom plan view of the concentrator 60 illustrates the internal cavity 24 of the concentrator 60. The air is directed from the blower 26 into the gas flow conduits 28 and through the nozzles 34 as shown in FIG. 3, thereby concentrating the air. When the interior diameter of the nozzles 34 is less than the interior diameter of the gas flow conduits 28 the air is further concentrated before exiting the nozzles 34.

Figure 6:
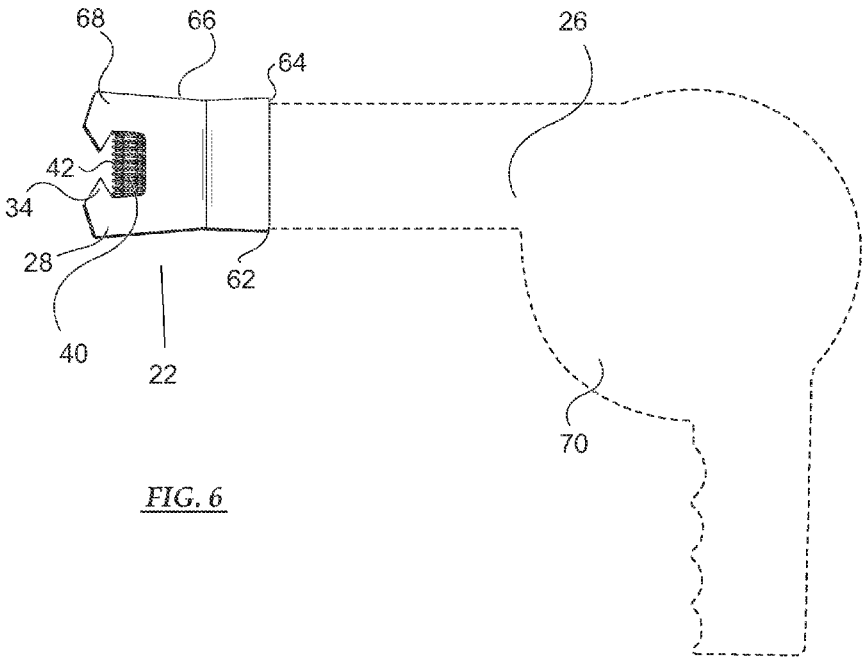
FIG. 6 shows the device of FIG. 3 mounted on a hair dryer.

FIG. 6 shows the concentrator 60 mounted on a hair appliance 70. In this figure the concentrator 60 is configured as an attachment which can be removably attached to the hair appliance 70. When the concentrator 60 is attached the otherwise conventional airflow of the hair appliance 70 is concentrated. In professional settings or for home use it often desirable to remove the concentrator 60 when it is configured as a separable adapter when drying is complete. When the concentrator 60 is removed an alternative hair drying attachment can now be used with the hair appliance 70.

Whether the features of the present invention are configured as an attachment with a hair appliance 70 or integral with a blower 26, the user needs only to hold the device 20 or hair appliance 70 with one hand, while selecting portion of the hair to be treated. When the section of hair is engaged the hair is pulled away from the user while the concentrated air is applied.

When the device 20 is integral with the blower 26, the hair may be simultaneously heated and styled without the use of a hair dryer which is very convenient for the user. Once the device 20 is activated the bar 40 with projecting bristles 42 can engage the hair of a user. The concentrated air in combination with the bar 40 with projecting bristles 42 engages the hair of the user thereby lifting the hair away from the user's scalp. As a result, the engaged section of hair is dried by the air exiting the one or more nozzles 34. As the user further pulls the device 20 away from their head the hair is lifted and glides over the bristle portion 42 in a brush-like manner. As a result air moves through the hair uniformly drying it in a smooth manner. By drying the hair using this method a voluminous smooth finish is created.

When the concentrator 60 is used as an attachment for drying and styling the hair the user places the concentrator 60 as described above on a hair appliance 70 having an outlet 62. The inlet 64 portion of the concentrator 60 is proximate to the hair appliance 70 outlet 62 and the hair appliance 70 is activated to blow air, usually heated through the concentrator 60.

In addition, it should be understood that aspects of the various embodiments may be interchanged both in whole or in part. Furthermore, those of ordinary skill in the art will appreciate that the foregoing description is by way of example only, and is not intended to be limitative of the invention so further described in the appended claims.

What is claimed is:

1. A hair treatment device comprising:

(a) a body;

(b) a blower supported by the body;

(c) a first gas flow conduit in gas flow communication with the blower, the first gas flow conduit having a longitudinal axis and a proximal portion supported by the body and a distal portion away from the body;

(d) a first nozzle in gas flow communication with the distal portion of the first gas flow conduit and oriented to blow air from the distal portion of the first gas flow conduit toward the body at an angle greater than one hundred degrees relative to the longitudinal axis;

(e) a second gas flow conduit in gas flow communication with the blower, the second gas flow conduit having a longitudinal axis and a proximal portion supported by the body and a distal portion away from the body;

(f) a second nozzle in gas flow communication with the distal portion of the first gas flow conduit and oriented to blow air from the distal portion of the first gas flow conduit toward the body at an angle greater than one hundred degrees relative to the longitudinal axis; and (g) a bar with projecting bristles located in between the first gas flow conduit and the second gas flow conduit and positioned so that air is blown from the first and second nozzles transversely onto the surface of the bar, wherein the hair is smoothed and polished as it is pulled over the bar.

2. The hair treatment device of of claim 1, wherein the longitudinal axes of both conduits are parallel to each other.

3. The hair treatment device of claim 1, wherein both nozzles have an internal diameter less than the internal diameter of the gas flow conduits.

4. The hair treatment device of claim 1, wherein the first nozzle has an internal diameter less than the internal diameter of the first gas flow conduit.

5. The hair treatment device of claim 1, wherein the body has an elongated longitudinal axis, with a gripping section positioned distal from the body.

6. A concentrator for use with a hair appliance outputting air through an outlet, the concentrator comprising:

a) a body having (i) an inlet sized to fit over the outlet of a hair treatment device, the inlet for receiving air output by the hair treatment device, (ii) a discharge end opposed to the inlet, and (iii) a gas flow path between the inlet and the discharge end;

b) a first gas flow conduit in gas flow communication with the discharge end of the body, the first conduit having a first longitudinal axis and proximal portion supported by the body and a distal portion away from the body;

c) a first nozzle in gas flow communication with the first conduit and oriented to blow air from the distal portion of the first conduit toward the body at an angle greater than one hundred degrees relative to the first longitudinal axis;

d) a second gas flow conduit having a second longitudinal axis and second nozzle in gas flow communication with the second conduit and oriented to blow air from the distal portion of the second conduit toward the body at an angle greater than one hundred degrees relative to the second longitudinal axis;

e) a second nozzle in gas flow communication with the first conduit and oriented to blow air from the distal portion of the first conduit; and f) a bar with projecting bristles located in between the first gas flow conduit and the second gas flow conduit and positioned so that air is blown from the first and second nozzles transversely onto the surface of the bar, wherein the hair is smoothed and polished as it is pulled over the bar.

7. The concentrator of claim 6, wherein both nozzles have an interior diameter less than the interior diameter of the gas flow conduits.

8. The concentrator of claim 6, wherein the first nozzle has an interior diameter less than the interior diameter of the first gas flow conduit.

9. The concentrator of claim 6, wherein the hair appliance is a hair dryer.

10. A hair appliance comprising:

a) a hair appliance for outputting heated air through an outlet; and b) the concentrator of claim 6 with the concentrator inlet fitted over the outlet of the hair appliance.

11. A method of drying a section of hair comprising the steps of:

a) grasping a hair treatment device, the hair treatment device comprising:

i) a body;

ii) a blower supported by the body;

iii) a first gas flow conduit in gas flow communication with the blower, the first gas flow conduit having a longitudinal axis and a proximal portion supported by the body and a distal portion away from the body; and iv) a first nozzle in gas flow communication with the distal portion of the first gas flow conduit and oriented to blow air from the distal portion of the first gas flow conduit toward the body at an angle greater than one hundred degrees relative to the longitudinal axis;

v) a second gas flow conduit in gas flow communication with the blower, the second gas flow conduit having a longitudinal axis and a proximal portion supported by the body and a distal portion away from the body;

vi) a second nozzle in gas flow communication with the distal portion of the first gas flow conduit and oriented to blow air from the distal portion of the second gas flow conduit toward the body at an angle greater than one hundred degrees relative to the longitudinal axis; and vii) a bar with projecting bristles located in between the first gas flow conduit and the second gas flow conduit and positioned so that air is blown from the first and second nozzles transversely onto the surface of the bar:

b) placing the section of hair adjacent to the bar in a location where the air is blown from the first and second nozzles;

c) before or after step (b), activating the blower to dry the hair; and d) pulling the bar through the hair while the air is blown from the first and second nozzles.

12. A method of drying a section of hair comprising the steps of:

a) placing a concentrator for use with a hair appliance outputting air through an outlet, with the concentrator inlet fitted over the outlet of the hair appliance, the concentrator comprising:

i) a body having (i) an inlet sized to fit over the outlet of a hair treatment device, the inlet for receiving air output by the hair treatment device, (ii) a discharge end opposed to the inlet, and (iii) a gas flow path between the inlet and the discharge end;

ii) a first gas flow conduit in gas flow communication with the discharge end of the body, the first conduit having a first longitudinal axis and proximal portion supported by the body and a distal portion away from the body;

iii) a first nozzle in gas flow communication with the first conduit and oriented to blow air from the distal portion of the first conduit toward the body at an angle greater than one hundred degrees relative to the longitudinal axis;

iv) a second gas flow conduit having a second longitudinal axis and second nozzle in gas flow communication with the second conduit and oriented to blow air from the distal portion of the second conduit toward the body at an angle greater than one hundred degrees relative to the second longitudinal axis;

v) a second nozzle in gas flow communication with the distal portion of the first gas flow conduit and oriented to blow air from the distal portion of the second gas flow conduit toward the body at an angle greater than one hundred degrees relative to the longitudinal axis; and vi) a bar with projecting bristles located in between the first gas flow conduit and the second gas flow conduit and positioned so that air is blown from the first and second nozzles transversely onto the surface of the bar;

b) placing the section of hair adjacent to the bar and in a location where the air is blown from the nozzle;

c) before or after step (b), activating the hair appliance to blow heated air through the concentrator; and d) pulling the bar through the section of hair while the air is blown from the first and second nozzles.

* * * * *